US007552611B2

(12) United States Patent
Lev et al.

(10) Patent No.: US 7,552,611 B2
(45) **Date of Patent: *Jun. 30, 2009**

(54) SHEET PROCESSING APPARATUS, METHOD OF USE, AND PLASTICALLY DEFORMED SHEET

(75) Inventors: Leonid C. Lev, West Bloomfield, MI (US); Ravi Verma, Shelby Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 58 days.

This patent is subject to a terminal disclaimer.

(21) Appl. No.: 11/871,292

(22) Filed: Oct. 12, 2007

(65) Prior Publication Data

US 2008/0028814 A1 Feb. 7, 2008

Related U.S. Application Data

(62) Division of application No. 10/763,666, filed on Jan. 23, 2004, now Pat. No. 7,293,445.

(60) Provisional application No. 60/478,672, filed on Jun. 13, 2003.

(51) Int. Cl.
*B21C 23/22* (2006.01)
*B21C 33/00* (2006.01)

(52) U.S. Cl. ..... 72/167; 72/184; 72/190; 72/197; 72/262

(58) Field of Classification Search ..... 72/57, 72/166, 167, 168, 184, 190, 194, 197, 205, 72/221, 224, 251, 262; 226/186, 187; 100/163 R, 100/164, 169

See application file for complete search history.

(56) References Cited

U.S. PATENT DOCUMENTS

| | | | | |
|---|---|---|---|---|
| 2,266,418 A | | 12/1941 | Evans | |
| 2,707,923 A | | 5/1955 | Hansen | |
| 3,357,222 A | * | 12/1967 | Konstandt | 72/146 |
| 3,372,972 A | | 3/1968 | Schmidt et al. | |

(Continued)

OTHER PUBLICATIONS

"The use of severe plastic deformation for microstructural control" Materials Science and Engineering A234 (2002).

(Continued)

*Primary Examiner*—David B Jones

(57) ABSTRACT

An apparatus for plastically deforming a work piece in the form of a sheet, comprising at least two cylindrical guide rolls rotatable in a first direction, each of said cylindrical guide rolls having an outer circumference; a bendable strip having a portion of at least one surface in communication with a portion of the outer circumference of each of the at least two guide rollers, said bendable strip being capable of motion around the at least two guide rollers in the first direction and exerting a force upon a work piece, a first cylindrical feeding roll rotatable in a second direction opposite to the first direction, said first cylindrical feeding roll having an outer circumference, a plastic deformation passage having a first surface and a second surface, at least a portion of the first surface being defined by a portion of the bendable strip, and at least a portion of the second surface being defined by the outer circumference of the first cylindrical feeding roll, wherein one or both of the bendable strip and the cylindrical feeding roll, when in motion, propel the work piece through the plastic deformation passage wherein it is plastically deformed.

25 Claims, 6 Drawing Sheets

U.S. PATENT DOCUMENTS

| | | | | | |
|---|---|---|---|---|---|
| 3,565,650 | A | * | 2/1971 | Cordon | 106/675 |
| 3,765,216 | A | | 10/1973 | Green | |
| 3,773,455 | A | * | 11/1973 | Warp | 425/146 |
| 3,911,705 | A | * | 10/1975 | Voorhes | 72/45 |
| 3,994,656 | A | * | 11/1976 | Van Ausdall | 425/391 |
| 4,061,011 | A | | 12/1977 | Green et al. | |
| 4,063,442 | A | * | 12/1977 | Martin, Sr. | 72/166 |
| 4,214,469 | A | * | 7/1980 | Wagner et al. | 72/258 |
| 4,257,251 | A | | 3/1981 | Jury | |
| 4,325,686 | A | * | 4/1982 | Leon et al. | 425/371 |
| 4,514,998 | A | | 5/1985 | Jury | |
| 4,598,564 | A | * | 7/1986 | Held | 72/111 |
| 4,636,345 | A | * | 1/1987 | Jensen et al. | 264/122 |
| 4,711,113 | A | * | 12/1987 | Benford | 72/197 |
| 5,431,036 | A | * | 7/1995 | Bogart | 72/171 |
| 6,007,320 | A | * | 12/1999 | Froese et al. | 425/143 |
| 6,350,329 | B1 | | 2/2002 | Troeger et al. | |
| 6,399,215 | B1 | | 6/2002 | Zhu et al. | |
| 6,533,876 | B1 | | 3/2003 | Cornelissen et al. | |
| 6,662,616 | B2 | * | 12/2003 | Bohlke et al. | |
| 6,712,916 | B2 | | 3/2004 | Mishra et al. | |
| 6,908,517 | B2 | | 6/2005 | Segal | |
| 7,065,999 | B2 | * | 6/2006 | Fukuchi et al. | 72/171 |
| 7,293,445 | B2 | * | 11/2007 | Lev et al. | 72/167 |
| 2001/0023719 | A1 | | 9/2001 | Troeger et al. | |

OTHER PUBLICATIONS

"Microstructural evolutions of the A1 strip prepared by rolling and continuous equal channel angular pressing" Acta Materialia Inc. (2002).

* cited by examiner

SHEET PROCESSING APPARATUS, METHOD OF USE, AND PLASTICALLY DEFORMED SHEET

This application is a divisional of U.S. Ser. No. 10/763,666 filed Jan. 23, 2004, now U.S. Pat. No. 7,293,445 and also claims priority of U.S. Provisional Application No. 60/478,672 filed Jun. 13, 2003 and assigned to the assignee of the present invention.

TECHNICAL FIELD

The present invention relates to apparatus, methods for producing plastically deformed sheets, especially metallic sheets and plastically deformed sheets produced by the disclosed method. More particularly, the invention relates to apparatus and methods of producing sheets of fine-grained alloys, especially fine-grained aluminum alloys.

BACKGROUND

Superplastic forming is emerging as an industrial process for making hard-to form aluminum sheet metal parts. The use of superplastic forming in commercial production of metallic sheet parts, especially aluminum sheets, should provide desirable improvements in both cost and efficiency. However, superplastic forming processes generally require the use of fine-grain sheet alloys, typically those having grain size of less than 10 microns. These fine-grain sheet alloys have traditionally been produced by imparting heavy cold plastic deformation to sheet metal through massive cold rolling reduction achieved in multiple rolling mill passes. A major concern for commercializing superplastic forming is that the process is inherently slow resulting in very long part forming times compared to the room temperature stamping process. High-rate superplastic forming has been demonstrated in many alloys, but requires the use of sheet metal having an ultra-fine grain microstructure, generally less than 1 to 2 microns. However, current industrial sheet metal processing done in traditional rolling mills has generally been unable to produce an ultra-fine microstructure.

Severe plastic deformation, through confined shear deformation, has been shown to produce ultra-fine grain size in aluminum alloys. Severe plastic deformation is usually achieved through procedures such as equal-channel angular pressing and high-pressure torsion. However, to date, neither of these procedures has been available for use in the processing of continuous metal strips or metal sheet stock.

A process known as continuous confined strip shearing has been proposed to address the disadvantages of equal-channel angular pressing. In this process, the friction forces from a feeding roll acting on an aluminum sheet or strip propel the sheet or strip along an upper die into a deformation zone having an angled channel. However, high friction forces acting from the upper die on the metal sheet and the deformation resistance in the deformation zone impede or stop the motion of the sheet. As a result, the sheet may slip and slide on the feeding roll, causing process instabilities and interruptions. Aluminum may also adhere to the surfaces that the sheet contacts, resulting in challenges for high-volume production processes.

BRIEF SUMMARY

Disclosed is an apparatus for plastically deforming a work piece in the form of a sheet, comprising at least two cylindrical guide rolls rotatable in a first direction, each of said cylindrical guide rolls having an outer circumference; a bendable strip having a portion of at least one surface in communication with a portion of the outer circumference of each of the at least two guide rollers, said bendable strip being capable of motion around the at least two guide rollers in the first direction and exerting a force upon a work piece, a first cylindrical feeding roll rotatable in a second direction opposite to the first direction, said first cylindrical feeding roll having an outer circumference, a plastic deformation passage having a first surface and a second surface, at least a portion of the first surface being defined by a portion of the bendable strip, and at least a portion of the second surface being defined by the outer circumference of the first cylindrical feeding roll, wherein one or both of the bendable strip and the cylindrical feeding roll, when in motion, propel the work piece through the plastic deformation passage wherein it is plastically deformed.

Also disclosed is a method of plastically deforming a work piece, comprising providing an apparatus comprising, at least two cylindrical guide rolls rotatable in a first direction, each of said cylindrical guide rolls having an outer circumference; a bendable strip having at least one surface in communication with a portion of the outer circumference of each of the at least two guide rollers, said bendable strip being capable of movement with the at least two guide rollers in the first direction and exerting a force upon a work piece, a cylindrical feeding roll rotatable in a second direction opposite to the first direction, said cylindrical feeding roll having an outer circumference, a plastic deformation passage having an first surface and a second surface, at least a portion of the first surface being defined by the bendable strip, and at least a portion of the second surface being defined by the outer circumference of the first cylindrical feeding roll, rotating the at least two cylindrically guide rolls in a first direction and the cylindrical feeding roll in a second direction, propelling a work piece into the plastic deformation passage by the rotation of one or both of the bendable strip or the feeding roll, plastically deforming the work piece in the plastic deformation passage, and removing a plastically deformed work piece from the plastic deformation passage.

Also disclosed is an apparatus for plastic deforming a metallic sheet, comprising at least two cylindrical guide rolls rotatable in a first direction, each of said cylindrical guide rolls having an outer circumference; a bendable strip having at least one surface in communication with a portion of the outer circumference of each of the at least two guide rollers, said bendable strip having a tension force to facilitate movement of the bendable strip with the at least two guide rollers in the first direction, a first cylindrical feeding roll rotatable in a second direction opposite to the first direction, said first cylindrical feeding roll having an outer circumference, a plastic deformation passage having a first surface, a second surface, and a channel, at least a portion of said first surface being defined by the bendable strip, and at least a portion of said second surface being defined by the outer circumference of the first cylindrical feeding roll, said channel being defined by an upper and lower die, said upper die being in communication with a portion of the bendable strip positioned between the at least two cylindrical guide rolls and said lower die being in communication with the outer circumference of the feeding roll, wherein the bendable strip exerts a force on a metallic sheet and one or both of the bendable strip or the cylindrical feeding roll when under motion propel the metallic sheet into the plastic deformation passage.

The above described apparatus and other features are exemplified by the following figures and detailed description.

BRIEF DESCRIPTION OF THE DRAWINGS

Referring now to the figures, which are meant to be exemplary embodiments, and wherein the like elements are numbered alike.

DETAILED DESCRIPTION OF THE PREFERRED EMBODIMENT

According to the current invention, an apparatus and method are proposed in which a plastically deformable work piece in the form of a sheet is extruded in as continuous a manner as possible in a rolling mill type apparatus. The apparatus may be referred to herein as a rolling extrusion mill and the method of using the apparatus as a rolling extrusion process.

The apparatus disclosed herein imparts plastic deformation to plastically deformable work pieces, especially those in the form of sheets or strips. In one embodiment, the apparatus for plastically deforming a work piece comprises at least two cylindrical guide rolls rotatable in a first direction, each of said cylindrical guide rolls having an outer circumference; a bendable strip having at least one surface in communication with a portion of the outer circumference of each of the at least two guide rollers, said bendable strip being capable of motion or rotation around the at least two guide rollers in the first direction, a first cylindrical feeding roll rotatable in a second direction opposite to the first direction, said first cylindrical feeding roll having an outer circumference, a plastic deformation passage having an first surface and a second surface, at least a portion of said first surface being defined by a portion of the bendable strip and at least a portion of said second surface being defined by a portion of the outer circumference of the first cylindrical feeding roll, wherein the bendable strip exerts a force on an inserted work piece and one or both of the bendable strip or cylindrical guide roll propel a work piece into the plastic deformation passage. A plastically deformed work piece is pushed out the plastic deformation passage by the propelled work piece.

Plastic deformation as used herein is defined as a permanent deformation that does not recover upon removal of the deforming force.

Figure 1A:
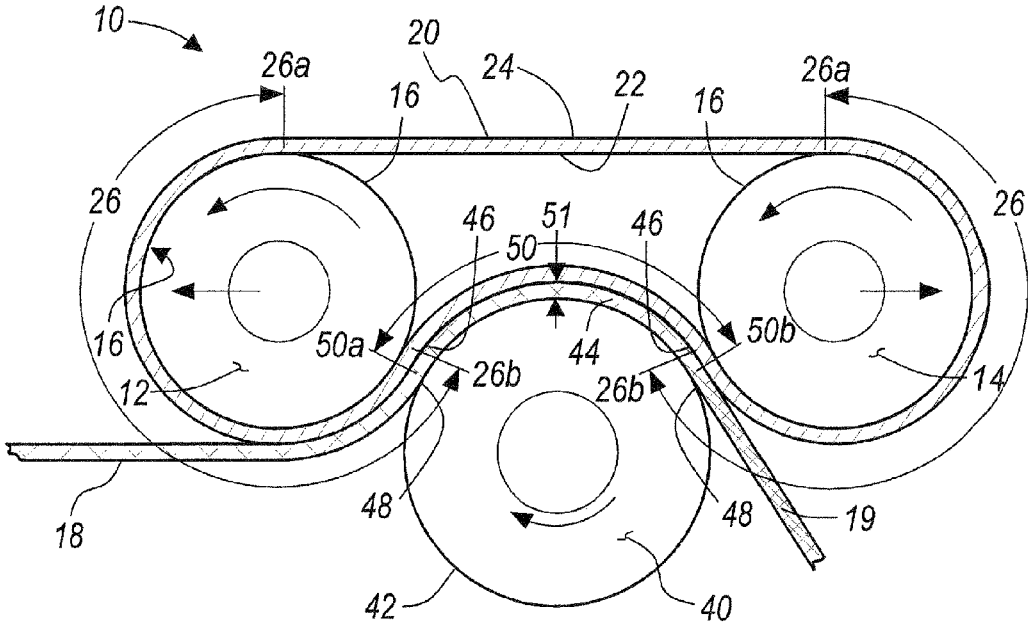
FIG. 1A is a schematic representation of one embodiment of the apparatus for plastically deforming a sheet.

Referring to FIG. 1A, a schematic view of one exemplary embodiment of the apparatus 10 for plastic deforming a work piece 18 is shown. The apparatus 10 has at least two cylindrical guide rolls 12 and 14 having an outer circumference or surface 16. Both guide rolls 12 and 14 are rotatable in a first direction, i.e., clockwise or counterclockwise. Each of the at least two cylindrical guide rolls 12 and 14 rotate in the same direction.

Cylindrical guide rolls 12 and 14 may be made of high strength steel, cemented carbides or any other material with a sufficient compressive strength and wear resistance so as to undergo only elastic deformations during the operation of the apparatus. Also, the rollers may be coated with a protective wear resistant coating. Illustrative examples of such protective coatings include ceramic coatings such as titanium nitride, tungsten carbide, chromium nitride, and the like.

Additional guide rollers may be used in addition to the at least two required guide rollers 12 and 14. Each additional cylindrical guide roll must rotate in the same direction as that of the at least two cylindrical guide rolls 12 and 14.

The apparatus 10 further comprises a bendable strip or chain 20 that is sufficiently flexible so as to be pliant and capable of bending and following the outer circumference of the at least two cylindrical guide rolls 12 and 14 and the feeding roll 40 in an arcuate curve. In one exemplary embodiment, the flexible strip 20 will be a continuous loop or belt. The term 'bendable strip' as used herein may be used interchangeably with 'belt', 'chain' and the like.

In general, bendable strip or chain 20 may be made of metal, plastic, rubber, or mixtures thereof. Illustrative examples of suitable metals include low-alloyed steel, high strength steel and the like. In one embodiment, the bendable strip may be made of a mixture of materials. For example, a bendable strip 20 may have a composite construction having a first layer that comprises inner surface 20 that is made of rubber or a rubber like material, while a layer made of a metal such as steel provides outer surface 24. In one exemplary embodiment, the bendable strip 20 will be made of low-alloyed steel.

FIG. 1A shows one exemplary embodiment where the bendable strip or chain 20 has an inner surface 22 and an outer surface 24. A portion 26 of the inner surface 22 of the bendable strip 20 is in communication with a portion of the outer circumference 16 of each of the at least two guide rolls 12 and 14. The portion 26 of the inner surface 22 of the bendable strip 20 is defined as that part of inner surface 22 that begins at point 26*a* and ends at point 26*b* when traveling in a clockwise fashion with respect to guide roll 14 and counterclockwise with respect to guide roll 12.

The bendable strip 20 as shown in FIG. 1A is looped, 'continuous' or infinite, i.e., a bendable strip having no end and no beginning. Examples of suitable continuous or infinite bendable strips 20 include those having circular or elliptical configurations. Of course, it will be appreciated that bendable strip 20 will assume any configuration as imposed by the particular requirements of the elements of apparatus 10. Continuous bendable strips 20 are especially suitable for use in the disclosed apparatus 10, particularly in embodiments of the invention designed to provide high volume outputs.

However, it is possible for the bendable strip 20 used in other embodiments of the apparatus 10 to be non-continuous. For example, non-continuous bendable strips 20 may be particularly suitable for smaller applications such as those encountered in laboratory settings and smaller scale up models of apparatus 10.

Figure 1B:
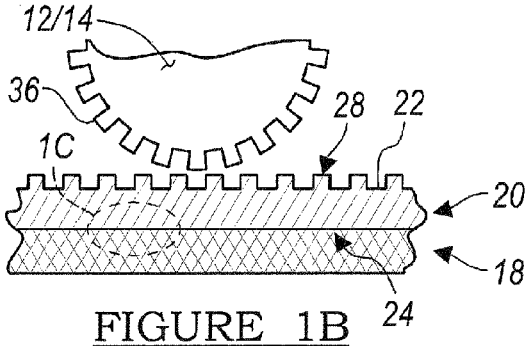
FIG. 1B is a close up schematic representation of one embodiment of the apparatus showing an alternative bendable strip 20.

Illustrative examples of suitable bendable strips 20, whether continuous or not, include bendable strips, belts and chains having inner and outer surfaces that may have structures thereon or be smooth, textured, rough or a combination thereof. One illustrative embodiment is shown in FIG. 1B, wherein the inner surface 22 of the bendable strip or chain 20 may be equipped with teeth 28 to prevent sliding between the cylindrical guide rolls 12 and 14 and the bendable strip 20. The rolls 12 and 14 may be equipped with corresponding teeth 36 that are adapted to mesh, engage or interact with the teeth 28 on the inner surface 22 of the bendable strip or chain 20. In addition, the guiding rolls 12 and 14 and feeding roll 40 may be barreled, crowned or otherwise profiled to guide the bendable strip 20.

Figure 1D:
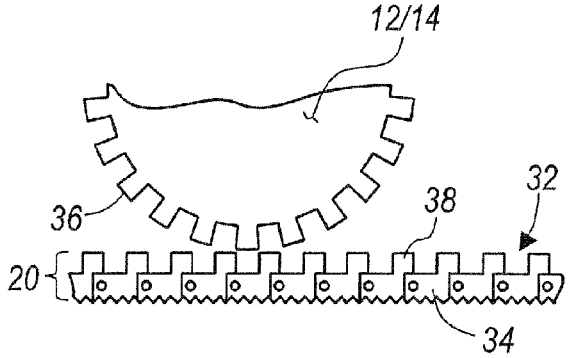
FIG. 1D is a schematic representation of an alternative embodiment of the bendable strip and guide rolls of FIG. 1A.
Figure 1C:
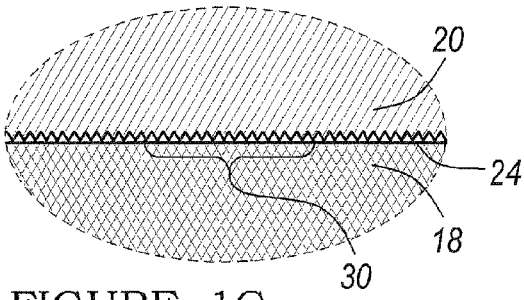
FIG. 1C is a close up view of a portion of FIG. 1B.

FIG. 1C illustrates another embodiment wherein the outer surface 24 of a bendable strip 20 may have one or more special surface roughness patterns 30 to increase the friction between the bendable strip 20 and a work piece 18. Surface roughness patterns 30 may be random or repetitive.

In another embodiment as shown in FIG. 1D, the bendable strip 20 may be a chain 32 with plates 34 attached to the chain links to form a continuous outer surface. The plates 34 may be manufactured to be parts of chain links. Otherwise, the plates can be connected to the chain links using welding, mechanical connectors or in other way. In this case, the outer circumference 16 of cylindrical guide rolls 12 and/or 14 may be equipped with teeth 36 to engage the plates 34 of the chain 32 in order to propel it.

It will be appreciated that the embodiments shown in FIGS. 1B, 1C, and 1D are illustrative only and that other embodiments of bendable strip 20 and cylindrical guide rolls 12 and 14 having interlocking or corresponding structural features are possible. For example, the outer circumference 16 of guide rolls 12 and 14 may be free of teeth, plates or chains intended to engage corresponding structural features on inner surface 22 of bendable strip 20. However, as shown in FIGS. 1B, 1C, and 1D, the use of such interlocking features on one or both of inner surface 22 and outer circumference 16 of guide rolls 12 and 14 provides increased control of the bendable strip 20 and thus work piece 18. In one embodiment the plates will not mark or damage a surface of the work piece 18. In another embodiment, the plates may be used to intentionally mark a surface of the work piece 18, for either functional or decorative purposes.

In one particularly exemplary embodiment, the bendable strip 20 will be made of steel having a surface roughness pattern on outer surface 24 and will be an infinite continuous loop that does not have a beginning or an end.

The bendable strip 20 has a tension force to facilitate the rotation of the bendable strip 20 with the first and second guide rolls 12 and 14 in the first direction. In one exemplary embodiment, this tension force results from the placement of the bendable strip 20 of a particular length in the form of an infinite loop around the guide rolls 12 and 14, and applying equal but opposite forces on the rolls. Such equal but opposite forces may be applied via the use of tensioners, springs, hydraulic mechanisms and the like as known to those of skill in the art. In another embodiment, the bendable strip 20 of a finite length (non continuous) can be held in tension and propelled between the rolls by interlocking of first structures, such as teeth, on the circumference of the guide rolls and second structures, such as chain links or teeth, on the inner surface of the bendable strip 20.

Returning to FIG. 1A, the rolling mill apparatus 10 will also comprise at least one cylindrical feeding roll 40 that is rotatable in a second direction and which has an outer circumference 42. The second direction of rotation must be opposite to the first direction of rotation of the at least two guide rolls 12 and 14 and the bendable strip 20.

Cylindrical feeding roll 40 may be made of materials such as are described above with respect to guide rolls 12 and 14. In one exemplary embodiment, the cylindrical feeding roll 40 will be made of steel.

The outer circumference 42 of feeding roll 40 may also possess various structural features designed to increase the friction between outer circumference 42 and work piece 18. Illustrative examples of such structural features include barreling, crowning, profiling and surface roughness patterns 30 as discussed above and as illustrated in FIG. 1C.

The rolling mill apparatus 10 also includes a plastic deformation passage 44 for plastically deforming the work piece 18. In the case of metallic work pieces 18, such plastic deformation will generate new crystallographic dislocations, which, upon annealing, will generate new desirable grain structure with small grain size.

The plastic deformation passage 44 in FIG. 1A is defined by a first surface 46 and a second surface 48.

In the embodiment shown in FIG. 1A, first surface 46 is defined by the outer surface 24 of bendable strip 20, more particularly the outer surface 24 of that portion of bendable strip 20 having an arcuate shape following that of the arcuate shape of outer circumference 42 of feeding roll 40. The second surface 48 of plastic deformation passage 44 in FIG. 1A is defined by the arcuate portion of outer circumference 42 of feeding roll. In this embodiment, plastic deformation passage 44 has a length 50 that begins at point 50*a* and ends at point 50*b* when traveling clockwise. The first surface 46 is juxtaposed relative to the second surface 48 so as to create a plastic deformation passage 44 there between having a height 51 that is no more than the original thickness of the work piece 18 before it enters the passage 44 at point 50*a*.

Work or energy is imparted to the deformable work piece 18 when it is propelled through the plastic deformation passage 44 as a result of the motion, movement or rotation of bendable strip 20 and feeding roll 40. This work or energy also depends on the configuration, dimensions, height, etc of the plastic deformation passage. The plastic deformation passage 44 will exert forces upon the work piece 18 as it passes through the length 50 of the passage 44. As a result, the work piece 18 is plastically deformed when it exits the plastic deformation passage 44 as plastically deformed work piece 19.

In the embodiment shown in FIG. 1A, such forces may result from the bendable strip 20, the guide rolls 12 and 14, the feeding roll 40 or a combination thereof. In this embodiment, the extent of the forces applied by the bendable strip 20, the guide rolls 12 and 14, and/or the feeding roll 40 will be dependent upon the height 51 of the passage 44.

In this embodiment, the plastic deformation passage 44 has a height that is the same throughout the length 50 of the passage 44. The plastic deformation passage 44 shown in FIG. 1A maintains approximately the same dimensions throughout and is no more than the thickness of deformable work piece 18 but is a height 51 that is sufficient to allow the imposition of plastic deformation forces from bendable strip 20, guide rolls 12 and 14 and/or feeding roll 40. The height 51 will never be more than the thickness of the original work piece 18 before it enters the plastic deformation passage 44 and in one exemplary embodiment of the apparatus 10 set forth in FIG. 1A will be equal to or less than the thickness of the original piece 18. In another exemplary embodiment, the height 51 of the apparatus 10 set forth in FIG. 1A will be less than the thickness of the original work piece 18.

It will be appreciated that while the passage 44 must exert plastic deformation forces upon the work piece 18, not all the forces exerted upon the work piece 18 over the entire length 50 of the passage 44 need to be plastically deforming forces. That is, some of the forces exerted upon the work piece 18 may only elastically deform the work piece 18. For example, in FIG. 1A, the pressure between the first guiding roll 12 and the feeding roll 40 may or may not plastically deform the deformable work piece 18. The extent of the force imposed by guide roll 12 will be a function of the height 51 at point 50*a*.

Figure 2:
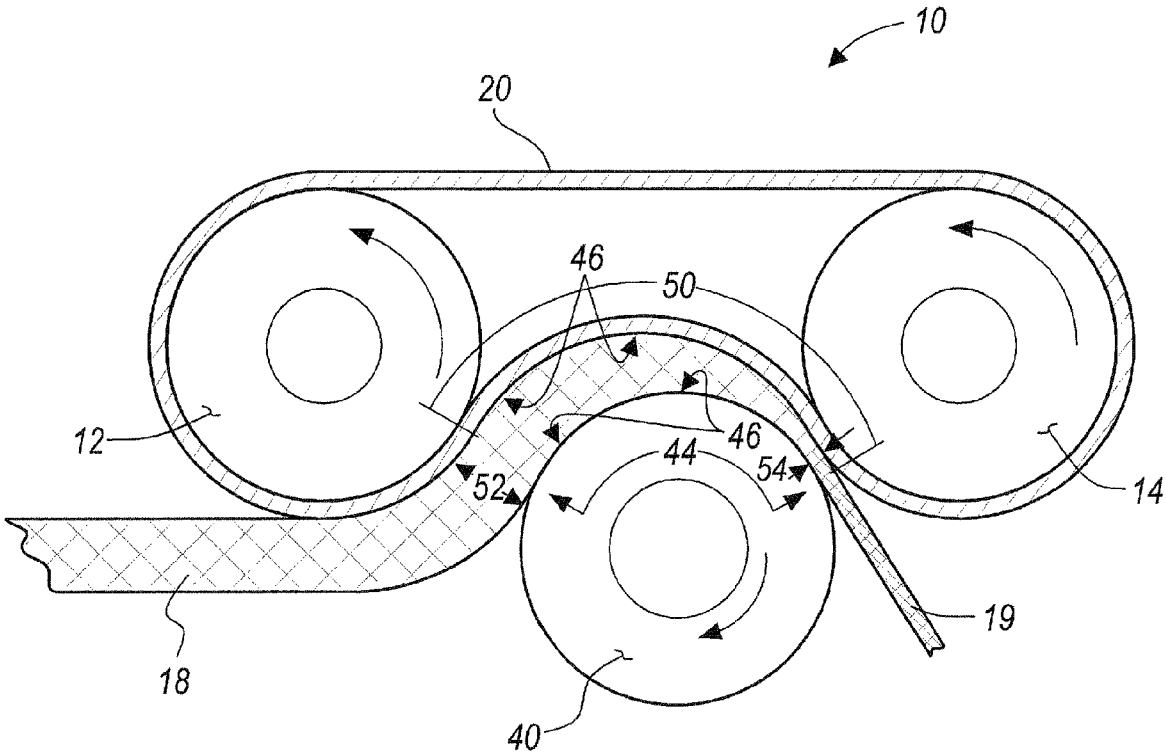
FIG. 2 is a schematic representation of a second embodiment of the apparatus for plastically deforming a sheet.

In another exemplary embodiment, the configuration of plastic deformation passage 44 is such that the height of the plastic deformation passage 44 may decrease over the length 50 to a height that is less than the thickness of the work piece 18 to be deformed. This is illustrated in the embodiment of FIG. 2, where the plastic deformation passage 44 has an initial height 52 but decreases over the length 50 to a final height 54, wherein final height 54 is less than initial height 52. The thickness of deformed work piece 19 is equal to final height 54 of the plastic deformation passage 44. Thus, in this embodiment, the thickness of the plastically deformed work piece 19 exiting the plastic deformation passage will be less than the thickness of the deformable work piece 18 entering the plastic deformation passage.

Returning to the embodiment shown in FIG. 1A, the rotation of cylindrical guide rolls 12 and 14 causes each guide roll to exert a force upon the bendable strip 20 and thus the deformable work piece 18 such that the work piece 18 is propelled through the passage 44. If the direction of rotation of the at least two guide rolls 12 and 14 is counter clockwise as shown in FIG. 1A, that portion of bendable strip 20 in cooperation with the outer circumference 16 of cylindrical guide roll 12 acts to push deformable work piece 18 toward plastic deformation passage 44. At the same time, the counter clockwise action of cylindrical guide roll 14 causes that portion of bendable strip 20 in cooperation with the outer circumference 16 of cylindrical guide roll 14 to pull deformable work piece 18 away from and out of plastic deformation passage 44.

Alternatively, if the direction of cylindrical guide rolls 12 and 14 was clockwise, that portion of bendable strip 20 in cooperation with the outer circumference 16 of guide roll 14 would push deformable work piece 18 toward plastic deformation passage 44 while that portion of bendable strip 20 in cooperation with the outer circumference 16 of cylindrical guide roll 12 would pull the work piece away from and out of plastic deformation passage 44. It will be appreciated that in this case, the work piece being pulled out would be a plastically deformed work piece 19.

The rotation of the cylindrical feeding roll 40 in a direction opposite to that of the at least two guide rolls 12 and 14 acts to propel the work piece 18 through the plastic deformation passage 44 in the direction of rotation of the feeding roll 40.

During the operation of the rolling mill apparatus 10, the feeding roll 40 rotates with a constant surface velocity V. The guide rolls 12 and 14 rotate and supply the bendable strip 20 with substantially the same or slightly higher velocity V. As illustrated in FIGS. 1A and 2, the deformable work piece 18 is fed between the bendable strip 20 and the feeding roll 40, into plastic deformation passage 44, with force being directed upon the bendable strip 20 from the pushing guide roll 12, the pulling guide roll 14, and the feeding roll 40. However, it is possible in some embodiments that the propulsion of the work piece 18 through the passage 44 may result from only one of the bendable strip 20 or the cylindrical feeding roll 40. For example, in one embodiment the bendable strip 20 will be the driver that provides the force to propel both the work piece 18 and the cylindrical feeding roll 40, and in another embodiment the cylindrical feeding roll 40 will be the driver that provides the force to propel the work piece 18 and the bendable strip 20.

Due to friction between the deformable work piece 18 and the bendable strip 20 and the feeding roll 40, the former is clamped by the bendable strip 20 and the feeding roll 40 so that it enters the plastic deformation passage 44.

Figure 3:
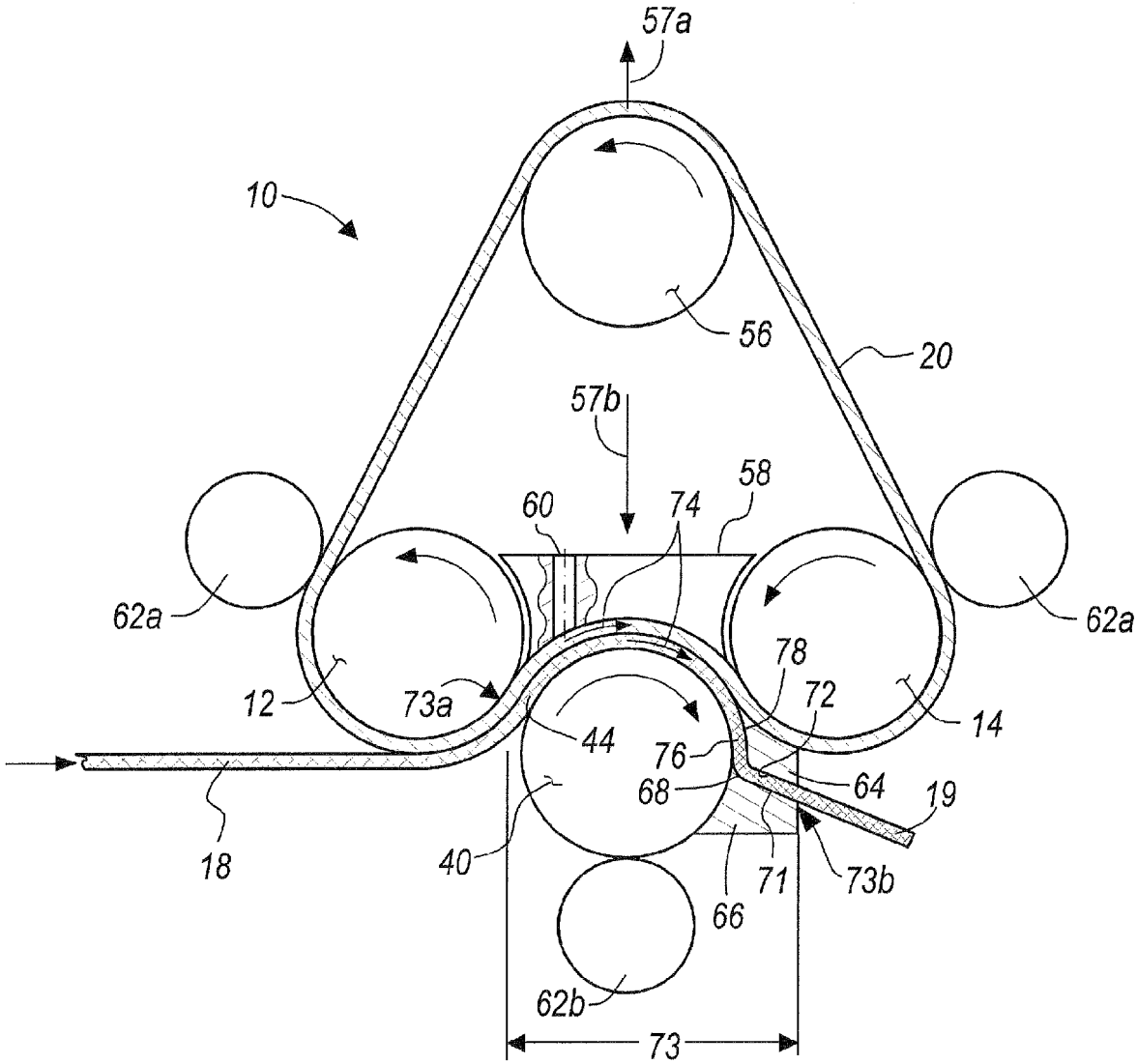
FIG. 3 is a schematic representation of a third embodiment of the apparatus for plastically deforming a sheet.
Figure 4:
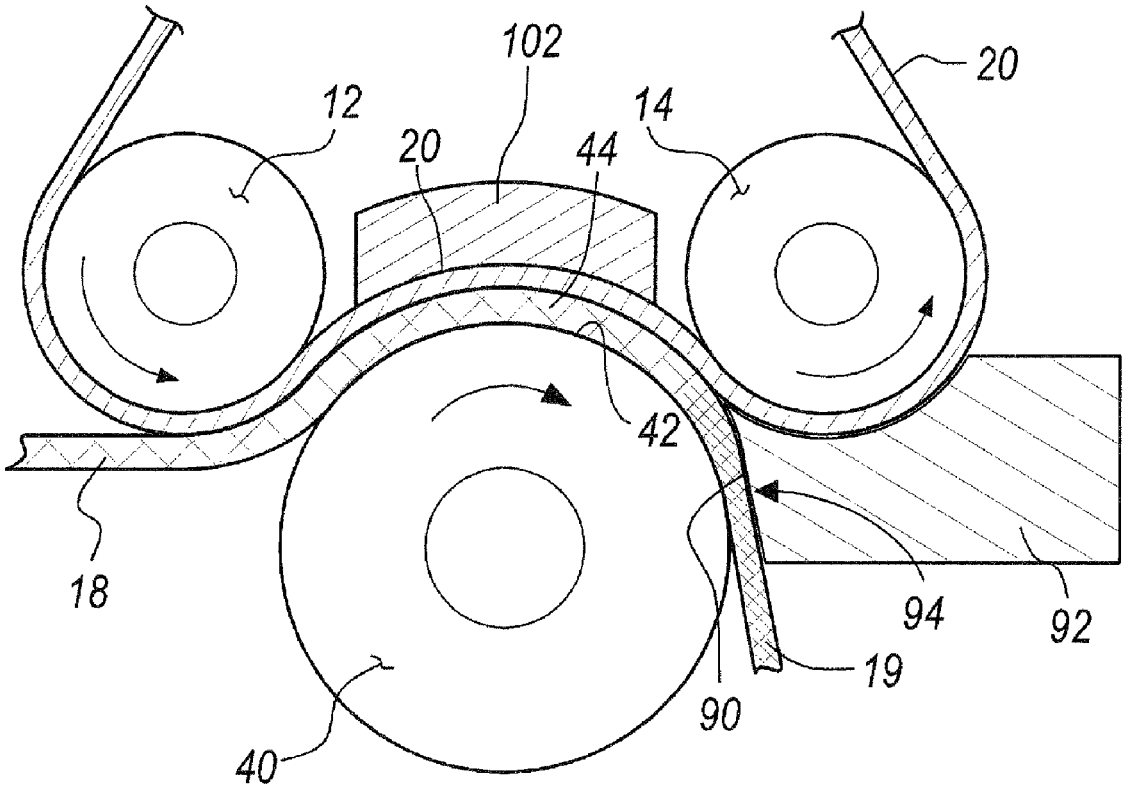
FIG. 4 is a schematic representation of a fourth embodiment of the apparatus for plastically deforming a sheet.

In all those embodiments where the feeding roll 40 acts to propel the deformable work piece 18, the friction between the feeding roll 40 and the deformable work piece 18 also propels the latter further along the plastic deformation passage 44. The tension force in the bendable strip 20 acts to compress the deformable work piece 18 between the bendable strip 20 and the outer circumference 42 of feeding roll 40 and facilitates the transmission of friction forces to the deformable work piece 18. The resultant friction forces from the bendable strip 20 and feeding roll 40 act on the deformable work piece 18 and force the deformable work piece 18 to enter the plastic deformation passage 44. When the deformable sheet reaches end of the plastic deformation passage in FIGS. 1A and 2, the plastically deformed work piece 19 is separated from the bendable strip 20. In case of the apparatus 10 in FIG. 2, the work piece 18 deforms not only due to bending around the feed roll 40, but also due to extrusion through the passage 44 that narrows from the entering height 52 to the exit height 54 (FIG. 2). In the case of the embodiments set forth in FIGS. 3 and 4 and discussed below, such plastic deformation also occurs as a result of the extrusion of the work piece 18 through the angled channels 68 (FIGS. 3 and 4.)

Deformable work piece 18 may be in the form of a sheet or strip. In one exemplary embodiment, the deformable work piece 18 will be a sheet. "Sheet" as used herein refers to a long piece of deformable material having a first dimension such as thickness, a second dimension such as width and a third dimension such as length, wherein the second dimension is at least 5 times the first dimension. In one exemplary embodiment, the second dimension will be at least 500 times the first dimension, while in another exemplary embodiment the second dimension will be at least 1000 times the first dimension. In addition, in one embodiment, the third dimension will be at least 1000 times the first dimension. In another exemplary embodiment, the third dimension will be at least 2000 times the first dimension. In one exemplary embodiment, the third dimension will be infinite or continuous such as when the sheet is in the form of a roll of sheet metal.

Illustrative examples of suitable sheets include those having a first dimension of less than about 10 mm, a second dimension greater than about 50 mm, and a third dimension greater than about 200 mm. Other suitable examples include sheets having a first dimension of from about 1 to 5 mm, a second dimension of from about 1 to 2 meters, and a third dimension of from about 500 to 1000 meters. In one exemplary embodiment, suitable sheets are those having a first dimension of from about 2 to 3 mm, a second dimension of from about 1.2 to 1.7 meters and a third dimension of more than about 1000 meters.

In another exemplary embodiment, the deformable work piece 18 will be as continuous as possible, i.e., without any breaks or interruptions. In another exemplary embodiment the deformable work piece 18 will be a continuous sheet.

Deformable work piece 18 may comprise one or more deformable materials. For example, in one exemplary embodiment, the deformable work piece may comprise a mixture of two or more deformable materials. In another exemplary embodiment, the deformable work piece 18 may be comprised of two or more deformable layers, such as a laminate. In such a case any of the deformable layers may comprise a mixture of two or more deformable materials.

Examples of illustrative deformable materials include deformable metals such as aluminum, magnesium, titanium, iron and their alloys, and mixtures thereof. Examples of suitable aluminum alloys include AA 5083 and AA6061.

In one exemplary embodiment, the work piece 18 will be a sheet of aluminum alloy.

Another embodiment of the disclosed apparatus 10 is illustrated in FIG. 3. In this embodiment, the rolling mill apparatus 10 of the invention is again equipped with at least one feeding roll 40, a bendable strip 20, at least two guide rolls 12 and 14, and a plastic deformation passage 44 as discussed above in regards to FIGS. 1 and 2. However, the apparatus 10 in FIG. 3 also includes a tension roll 56, one or more guiding shoes 58, an upper die 64, a lower die 66, and back-up rollers 62*a* and *b*. The at least two guiding rolls 12 and 14, bendable strip 20, and feeding roll 40 and their various corresponding components are as described above.

In this exemplary embodiment, the one or more guide shoes 58 have holes 60 through which lubricants may be supplied to decrease friction between the shoes 58 and the bendable strip 20. Suitable lubricants include oils, supplied through the holes 60 under high pressure. Another example of lubricants may be solid lubricants that fill in the holes 60 before the apparatus is used.

The shoe guide 58 as illustrated in the embodiment of FIG. 3 has a sliding surface that is in communication with a portion of the bendable strip. The shoe guide 58 is positioned between the two cylindrical rollers 12 and 14. In one embodiment, the shoe guide 58 will be in communication with the portion of the bendable strip that defines at least a portion of the first surface of the plastic deformation passage 44. In another embodiment, the shoe guide 58 will be in communication with that portion of the bendable strip opposite to the feeding roller.

The exemplary embodiment of FIG. 3 also includes a plastic deformation passage 44 that further comprises an angled extrusion channel 68 formed by an upper die 64 and a lower die 66 through which deformable work piece 18 must pass. The angled channel 68 is defined by the surface 72 of the upper die 64 and the surface 71 of the lower die 66. The upper die 64 is in communication with a portion of the bendable strip and said lower die being in communication with the outer circumference of the feeding roll 40. Thus, the surfaces 72 and 71 define a portion of plastic deformation passage 44.

In this case, the plastic deformation passage 44 begins at the point 73*a* at which the deformable work piece 18 is first compressed between the feeding roll 40 and the bendable strip 20. At this point, bendable strip 20 has an arcuate shape corresponding to the arcuate shape of the outer circumference 42 of feeding roll 40. The plastic deformation passage ends at the point 73*b* where the deformed work piece 19 exits the angled channel 68.

Turning briefly now to FIG. 4, another example of a plastic deformation passage 44 is illustrated. In this embodiment, the plastic deformation passage 44 includes a narrowing extrusion channel 90 formed by a straight extrusion die 92, through which the deformable work piece 18 must pass. In the narrowing extrusion channel 90, the deformable work piece 18 is compressed and plastically deformed between the surface 94 of the die 92 and the outer circumference 42 of the feeding roller 40.

It will be appreciated that in yet another exemplary embodiment, the plastic deformation passage 44 may include a combination of the narrowing extrusion channel 90 shown in FIG. 4 with the angled extrusion channel 68 of FIG. 3 in series.

In another embodiment of the apparatus set forth in FIG. 4, the plastic deformation passage may further comprise a heating element 102 that can supply heat to the deformable work piece 18 as it passes through passage 44.

Returning to the apparatus 10 shown in FIG. 3, upper and lower dies 64 and 66 may generally be formed of steel but may also be formed of cemented carbide. In one exemplary embodiment, the dies 64 and 66 will be made of steel.

The upper die 64 maybe in communication with that portion of the bendable strip 20 that is in communication with one of the cylindrical rollers 12 or 14.

If one or more back-up rollers 62 are employed, the preferable back-up roller configuration is such that they exert a self-equilibrating system of forces on the feeding and guiding rollers as illustrated by FIG. 3. That is, the forces created by back-up rollers 62*a* upon guide rollers 12 and 14 and 62*b* upon feeding roll 40 should balance out. The back-up rollers 62 can thus exert a force upon one or both of the guide rolls 12 and 14.

In this exemplary embodiment as shown in FIG. 3, tension roller 56 applies a force 57*a* that is equal and opposite to the net force 57*b* exerted by the bendable strip 20 on the roller.

The tension rollers 56 and back up rollers 62 will generally be made of materials as described above with respect to guide rollers 12 and 14 and feeding roll 40. Similarly, tension rollers 56 may be barreled, crowned or otherwise profiled to guide the bendable strip. Also, in each pair of contacting rollers only one may be barreled while the other one may be conforming to the first one.

During the operation of the proposed rolling mill 10 of FIG. 3, the feeding roll 40 rotates with the constant surface velocity V. The guiding rolls 12 and 14 and tension roll 56 rotate and supply the bendable strip 20 with substantially the same or slightly higher velocity V. In the embodiment disclosed in FIG. 3, a continuous deformable work piece 18 is fed between the bendable strip 20 and feeding roll 40 with force being directed upon the bendable strip 20 from the pushing guide roll 12 and the pulling guide roll 14.

Due to friction between the bendable strip 20 and the deformable work piece 18, the latter is drawn in between the bendable strip 20 and the feeding roll 40. In one exemplary embodiment, the pressure between the first guiding roll 12 and the feeding roll 40 may deform the deformable work piece 18 and decrease its thickness. The friction between the feeding roll 40 and the deformable work piece 18 propels the later further along the length 73 of plastic deformation passage 44 such that it forms an arcuate shape with respect to the shape of feeding roll 40. The guide shoe 58 compresses the deformable work piece 18 between the bendable strip 20 and the feeding roller 40 and facilitates the transmission of friction forces to the deformable work piece 18. The friction forces from the bendable strip 20 and feeding roll 40 act on the deformable work piece 18 in the same direction (shown with arrows 74 in FIG. 3) and force the work piece to enter a pre-channel 76 formed by the side surface 78 of upper die 64 and the outer circumference 42 of feeding roll 40. Work piece 18 is then extruded through the angled channel 68 to result in a deformed work piece 19.

Thus, in the proposed method of plastically deforming a work piece 18 as described above, a deformable work piece 18 is pushed and pulled into the plastic deformation passage 44 by the action of bendable strip 20. The work piece 18 is then propelled along the length 73 of plastic deformation passage 44 into pre-channel 76 and angled channel 68 by friction from the feeding roll 40 and from the bendable strip 20.

To increase the durability of the bendable strip 20, it is proposed in one exemplary embodiment to operate it at a stress level below its endurance limit, $\bar{o}_E$. The largest stress $\bar{o}$ in the bendable strip 20 is a combination of the bending stress and the tensile stress: $\bar{o}=\bar{o}_B+\bar{o}_T<\bar{o}_E$. The bending stress, $\bar{o}_B$ can be found as: $\bar{o}_B$=Et/d, where E is the Young's elastic modulus of the bendable strip material, t is the bendable strip thickness and d is the diameter of the smallest of the rollers. The tensile stress $\bar{o}_T$ depends on the placement of the tension roll 56 vis-à-vis the rest of the rolling mill and on the magnitude of the tension force as displayed by force vectors 57*a* or 57*b*.

The disclosed method of plastic deforming a work piece such as a sheet may be repeated a number of times. That is, the deformed work piece 19 extruded by the apparatus 10 may be reintroduced in the apparatus 10 one or more times. Thus a plastically deformed work piece 19 may be capable of additional deformation and may be used as deformable work piece 18. Repeated cycles of rolling and extruding the deformable work piece results in substantial plastic deformation that acts as a driving force for material recrystallization and refinement of grain structure. It will be appreciated that increasing the number of cycles of rolling and extrusion in the apparatus of the invention will result in increasingly fine-grained sheet metal.

Figure 5:
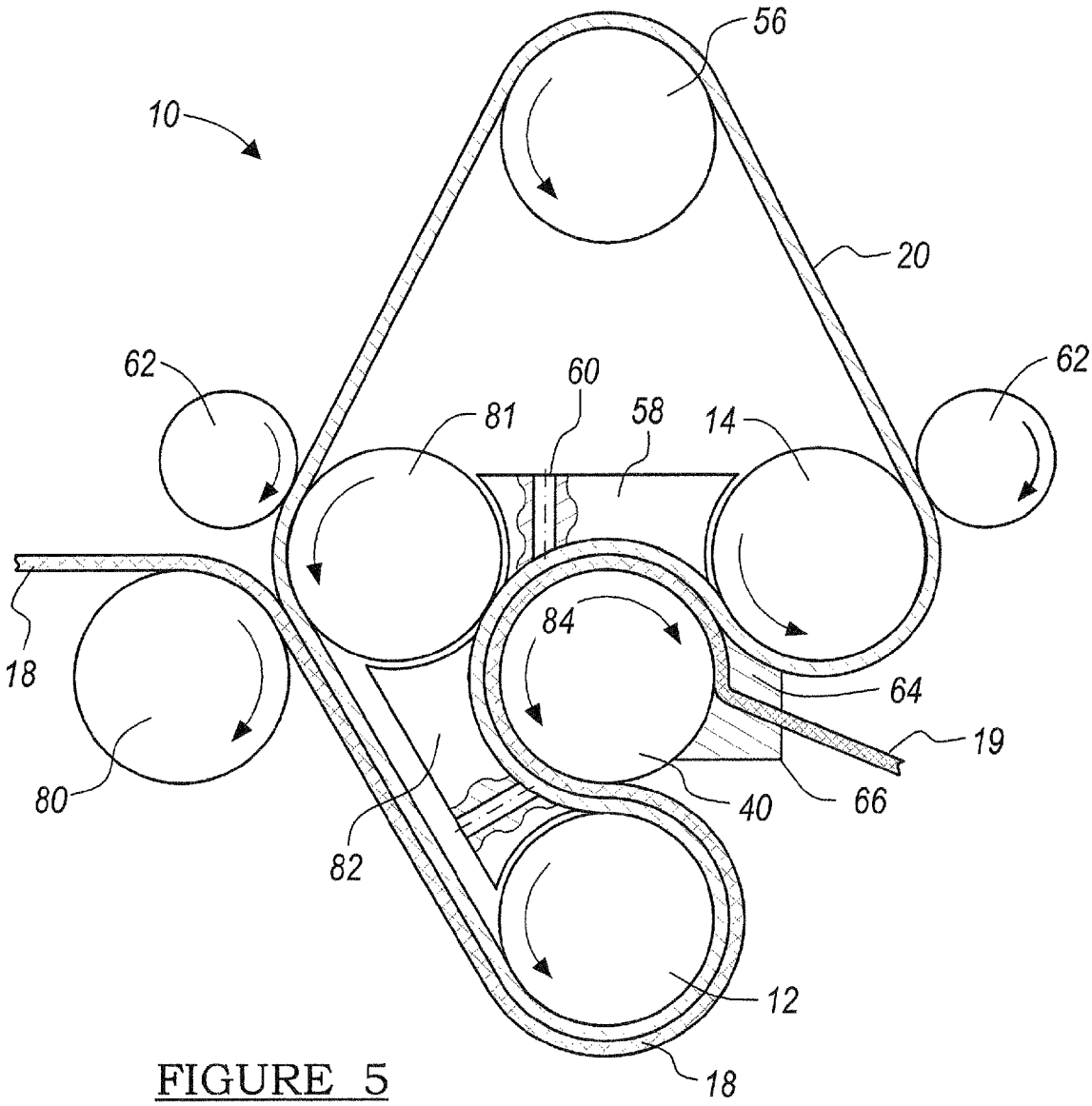
FIG. 5 is a schematic representation of a fifth embodiment of the apparatus for plastically deforming a sheet.

FIG. 5 shows another variation of the disclosed apparatus and corresponding method. In this case, apparatus 10 includes two additional rolls 80 and 81, and an additional guide shoe 82. The roll 81 replaces the backup roll 62*b* in the apparatus in FIG. 3. All other elements are as discussed above in FIG. 3. The configuration of guide rolls 12 and 14, and feeding rolls 40 and 81 results in a larger wrap length 84 of work piece 18 around feeding rolls 40 and 81. This increases the friction force exerted by the bendable strip 20 and the feeding rolls 40 and 81 on the deformable work piece 18, as according to Eiler's formula:

$$\frac{T2}{T1} = e^{\alpha\mu}.$$

In the above formula, T1 is the tangential force acting on the deformable work piece 18 on coming in contact with the feeding roll 81 and T2 is the tangential force acting on the deformable work piece 18 on separating from the feeding roll 40, $\alpha$ is the wrap angle around the feeding rolls 81 and 40, and $\mu$ is the combined friction coefficient due to friction forces acting on the deformable work piece 18 from the bendable strip 20 and feeding rolls 40 and 81.

Figure 6:
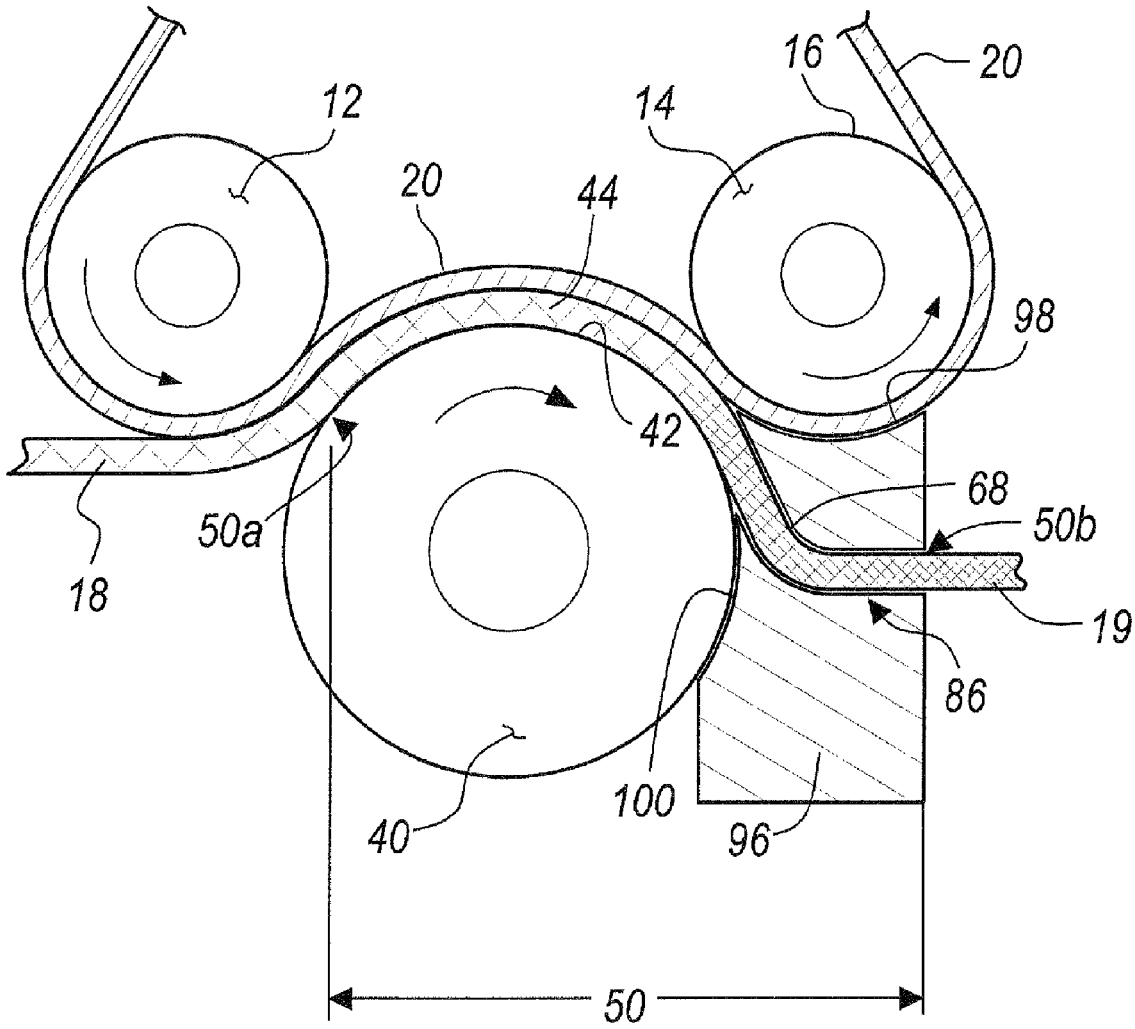
FIG. 6 is a schematic representation of a sixth embodiment of the apparatus for plastically deforming a sheet.

Turning now to FIG. 6, plastic deformation passage 44 may also comprise an angled extrusion channel 68 that is cut through the interior of a single die 96. Single die 96 has at least one outer surface 98 that is in communication with the portion of bendable strip 20 having an arcuate shape corresponding to the outer circumference 16 of guide roll 14. Single die 96 also has a second outer surface 100 that is in communication with feeding roll 40 and has an arcuate shape corresponding to the outer circumference 42 of feeding roll 40.

Unless otherwise indicated, all numbers expressing quantities of ingredients, properties such as molecular weight, reaction conditions, and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in specific examples are reported as precisely as possible. Any numerical value, however, inherently contain certain errors necessarily resulting from the standard deviation found in their respective testing measurements.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

We claim:

1. An apparatus for plastically deforming a work piece in the form of a sheet, comprising:

at least two cylindrical guide rolls rotatable in a first direction, each of said cylindrical guide rolls having an outer circumference;

a bendable strip having a portion of at least one surface in communication with a portion of the outer circumference of each of the at least two guide rollers, said bendable strip being capable of motion around the at least two guide rollers in the first direction and exerting a force upon a work piece, the bendable strip including a plurality of structures on at least a portion of at least one surface of the bendable strip;

a first cylindrical feeding roll rotatable in a second direction opposite to the first direction, said first cylindrical feeding roll having an outer circumference; and a plastic deformation passage having a first surface and a second surface, at least a portion of the first surface being defined by a portion of the bendable strip, and at least a portion of the second surface being defined by the outer circumference of the first cylindrical feeding roll, wherein one or both of the bendable strip and the cylindrical feeding roll, when in motion, propel the work piece through the plastic deformation passage wherein it is plastically deformed.

2. The apparatus of claim 1 wherein the bendable strip has a tension force to facilitate the motion of the bendable strip with the at least two guide rolls in the first direction.

3. The apparatus of claim 1 wherein the portion of the bendable strip that defines a portion of the first surface of the plastic deformation passage is positioned between the at least two cylindrical guide rolls.

4. The apparatus of claim 3 wherein the portion of the bendable strip that defines a portion of the first surface of the plastic deformation passage is adjacent to a portion of the bendable strip in communication with the outer circumference of at least one cylindrical guide roll.

5. The apparatus of claim 1 further comprising a plurality of structures on the outer circumference of at least one of the cylindrical guide rolls.

6. The apparatus of claim 5 wherein the plurality of structures on the at least one of the cylindrical guide rolls comprise at least one structure selected from teeth, barreling, surface pattern roughness, chain links and mixtures thereof.

7. The apparatus of claim 5 wherein the plurality of structures located on the bendable strip are adapted to engage with the plurality of structures located on the at least one of the cylindrical guide rolls when the cylindrical guide rolls and bendable strip are under motion.

8. The apparatus of claim 7 wherein the structures on the at least one of the cylindrical guide rolls and the bendable strip are teeth adapted to engage each other.

9. The apparatus of claim 1 wherein the plurality of structures on the bendable strip comprises at least one structure selected from teeth, barreling, surface pattern roughness, chain links and mixtures thereof.

10. The apparatus of claim 1 wherein the outer circumference of the cylindrical feed roller further comprises at least one structure selected from teeth, barreling, surface pattern roughness, chain links and mixtures thereof.

11. The apparatus of claim 1 wherein the bendable strip is a continuous loop.

12. The apparatus of claim 1 wherein the bendable strip comprises a beginning and an end.

13. The apparatus of claim 1 wherein the bendable strip further comprises an inner surface and an outer surface, at least a portion of the inner surface being in communication with the outer circumference of the cylindrical guide rolls and at least a portion of the outer surface being in communication with the work piece.

14. An apparatus for plastically deforming a work piece in the form of a sheet, comprising:

at least two cylindrical guide rolls rotatable in a first direction, each of said cylindrical guide rolls having an outer circumference;

a bendable strip having a portion of at least one surface in communication with a portion of the outer circumference of each of the at least two guide rollers, said bendable strip being capable of motion around the at least two guide rollers in the first direction and exerting a force upon a work piece;

a first cylindrical feeding roll rotatable in a second direction opposite to the first direction, said first cylindrical feeding roll having an outer circumference; and a plastic deformation passage having a first surface and a second surface, at least a portion of the first surface being defined by a portion of the bendable strip, and at least a portion of the second surface being defined by the outer circumference of the first cylindrical feeding roll, wherein one or both of the bendable strip and the cylindrical feeding roll, when in motion, propel the work piece through the plastic deformation passage wherein it is plastically deformed, wherein the work piece has a thickness and a portion of the plastic deformation passage has a height that is no more than the thickness of the work piece, and wherein a portion of the plastic deformation passage has a height that is less than the thickness of the work piece.

15. The apparatus of claim 14 wherein the plastic deformation channel further comprises a heating element for supplying heat to the work piece.

16. The apparatus of claim 14 wherein the plastic deformation passage has an initial height and a final height and said final height is less than said initial height and said initial height is no more than the thickness of the work piece.

17. The apparatus of claim 14 wherein the work piece is a sheet having a width and a thickness, said width being at least five times said thickness.

18. The apparatus of claim 17 wherein the work piece is a sheet of aluminum.

19. An apparatus for plastically deforming a work piece in the form of a sheet, comprising:

at least two cylindrical guide rolls rotatable in a first direction, each of said cylindrical guide rolls having an outer circumference;

a bendable strip having a portion of at least one surface in communication with a portion of the outer circumference of each of the at least two guide rollers, said bendable strip being capable of motion around the at least two guide rollers in the first direction and exerting a force upon a work piece;

a first cylindrical feeding roll rotatable in a second direction opposite to the first direction, said first cylindrical feeding roll having an outer circumference;

a plastic deformation passage having a first surface and a second surface, at least a portion of the first surface being defined by a portion of the bendable strip, and at least a portion of the second surface being defined by the outer circumference of the first cylindrical feeding roll; and at least one shoe guide located between the at least two cylindrical rollers, the at least one shoe guide including at least one sliding surface, said shoe guide being in communication with a portion of the bendable strip;

wherein one or both of the bendable strip and the cylindrical feeding roll, when in motion, propel the work piece through the plastic deformation passage wherein it is plastically deformed.

20. The apparatus of claim 19 wherein the sliding surface is in communication with the port ion of the bendable strip.

21. The apparatus of claim 20 wherein the shoe guide comprises one or more channels to supply lubrication to lubricate the sliding surface in communication with the bendable strip.

22. The apparatus of claim 19 further comprising one or more back up rollers in communication with the outer circumference of the at least one feeding roller.

23. The apparatus of claim 19 further comprising one or more back up rollers in communication with the bendable strip.

24. The apparatus of claim 19, wherein the plastic deformation passage further includes a channel, said channel being defined by an upper and lower die, said upper die being in communication with a portion of the bendable strip positioned between the at least two cylindrical guide rolls and said lower die being in communication with the outer circumference of the feeding roll.

25. A method of plastically deforming a work piece, comprising providing an apparatus comprising, at least two cylindrical guide rolls rotatable in a first direction, each of said cylindrical guide rolls having an outer circumference;

a bendable strip having at least one surface in communication with a portion of the outer circumference of each of the at least two guide rollers, said bendable strip being capable of movement with the at least two guide rollers in the first direction and exerting a force upon a work piece; and a cylindrical feeding roll rotatable in a second direction opposite to the first direction, said cylindrical feeding roll having an outer circumference;

a plastic deformation passage having an first surface and a second surface, at least a portion of the first surface being defined by the bendable strip, and at least a portion of the second surface being defined by the outer circumference of the first cylindrical feeding roll;

rotating the at least two cylindrically guide rolls in a first direction and the cylindrical feeding roll in a second direction;

propelling a work piece into the plastic deformation passage by the motion of one or both of the bendable strip or the feeding roll;

plastically deforming the work piece in the plastic deformation passage, and removing a plastically deformed work piece from the plastic deformation passage; and reintroducing the resulting plastically deformed work piece back into the provided apparatus.

* * * * *